United States Patent [19]

Gootoff et al.

[11] Patent Number: 5,029,357

[45] Date of Patent: Jul. 9, 1991

[54] PERSONAL CARE DEVICE

[76] Inventors: Philip Gootoff; Marie Gootoff, both of 2710 NE. 56th Ct., Fort Lauderdale, Fla. 33308

[21] Appl. No.: 289,778

[22] Filed: Dec. 27, 1988

[51] Int. Cl.[5] ..... A47L 17/00

[52] U.S. Cl. ..... 15/147 R; 15/210 R; 15/227; 15/244.1

[58] Field of Search ..... 15/147, 210 R, 154, 15/227, 244.1, 244.4; 604/1

[56] References Cited

U.S. PATENT DOCUMENTS

| | | | |
|---|---|---|---|
| 867,080 | 9/1907 | Rife | 15/154 X |
| 2,531,304 | 11/1950 | Seewald | 15/209 |
| 2,998,614 | 9/1961 | Winch | 15/210 R |
| 3,221,356 | 12/1965 | Schirmer | 15/210 |
| 3,225,375 | 12/1965 | Atkinson et al. | 15/210 R |
| 3,383,158 | 5/1968 | Leland | 401/201 |
| 3,495,918 | 2/1970 | Leland | 401/201 |
| 3,545,876 | 1/1970 | Leland | 401/201 |

*Primary Examiner*—Frankie L. Stinson

*Attorney, Agent, or Firm*—Oltman and Flynn

[57] ABSTRACT

A personal care device for holding a disposable paper wiping sleeve. The device has elongated front and rear handle members, each with a downwardly and forwardly inclined foot segment at its lower ends. The handle members are slidably coupled to each other for selective adjustment manually between (a) a normal position in which the foot segment of the rear handle member is up against the foot segment of the front handle member to hold the wiping sleeve encircling them and (b) a release position in which the foot segment of the rear handle member is displaced down from the foot segment of the front handle member.

4 Claims, 2 Drawing Sheets

FIG. 2
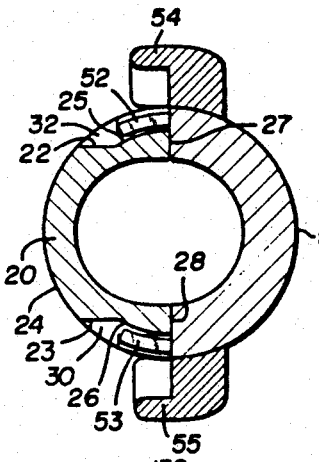
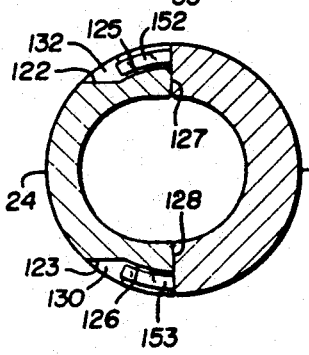
FIG. 3
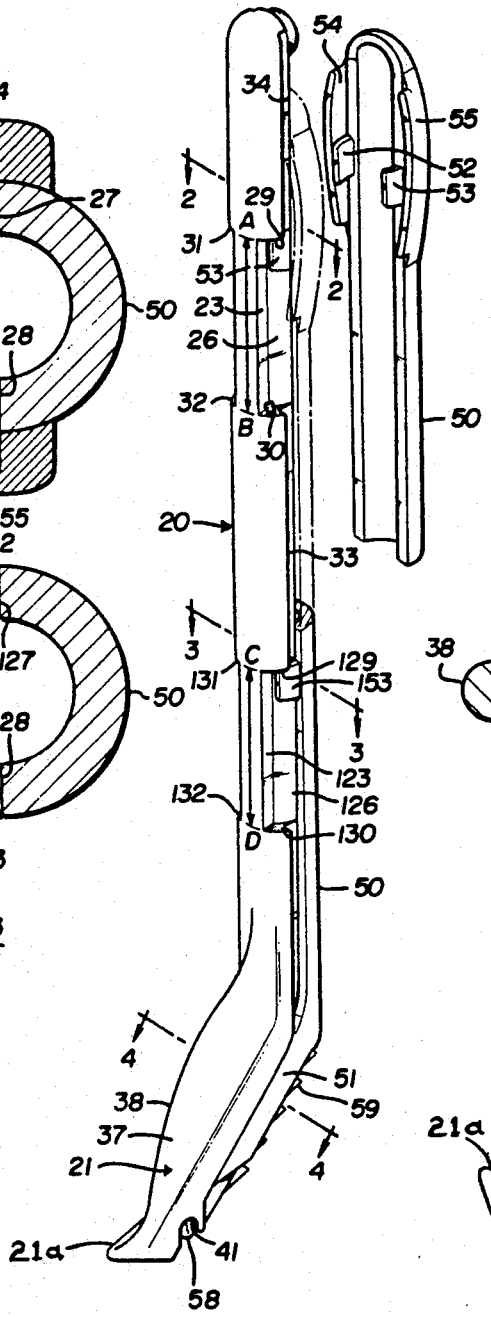
FIG. 1
FIG. 4
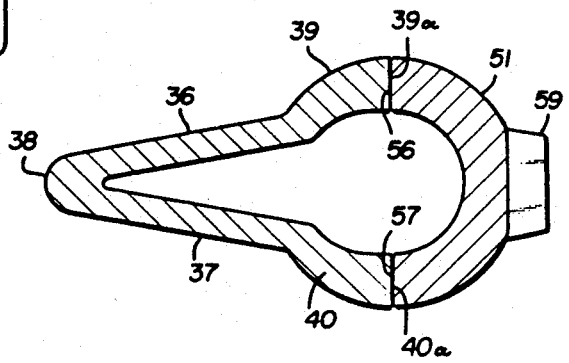
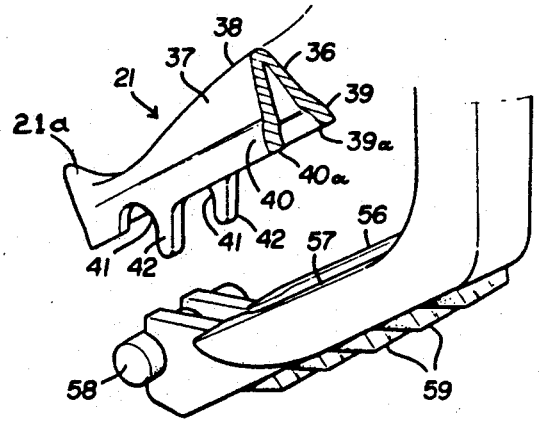
FIG. 5

PERSONAL CARE DEVICE

SUMMARY OF THE INVENTION

This invention relates to a device for holding a wiper element for use in personal hygiene by a person disabled by age or physical condition from using toilet tissue in a conventional manner and for discarding the wiper element after use.

A principal object of this invention is to provide such a device which is conveniently and effectively usable by a physically impaired person.

Another object of this invention is to provide such a device which enables the used wiper element to be readily disposed of without being touched by the user.

Preferably, the present invention comprises front and rear handle members with forwardly and downwardly inclined foot segments at their lower ends which normally extend contiguously, one behind the other, for holding a wiper element of paper or the like. The handle members are slidable with respect to one another to separate their foot segments and cause the used wiper element to drop off. The foot segment of the rear handle member has slanted teeth which enable a tubular wiper element to be slid onto the foot segments of the two handle members when they are contiguous but holds it securely in place during use.

Further objects and advantages of this invention will be apparent from the following detailed description of a presently preferred embodiment which is illustrated schematically in the accompanying drawings.

DESCRIPTION OF THE DRAWINGS

FIG. 1 is a perspective view, partly exploded, of a holder device in accordance with the present invention;

FIG 2 is a cross-section taken along the line 2—2 in FIG. 1 with the two handle members of the holder device assembled and in their normal position for holding a disposable wiper sleeve;

FIG. 3 is a similar view taken along the line 3—3 in FIG. 1;

FIG. 4 is a cross-section taken along the line 4—4 in FIG. 1;

FIG. 5 is a fragmentary exploded perspective view of the foot segments of the two handle members;

Figure 6:
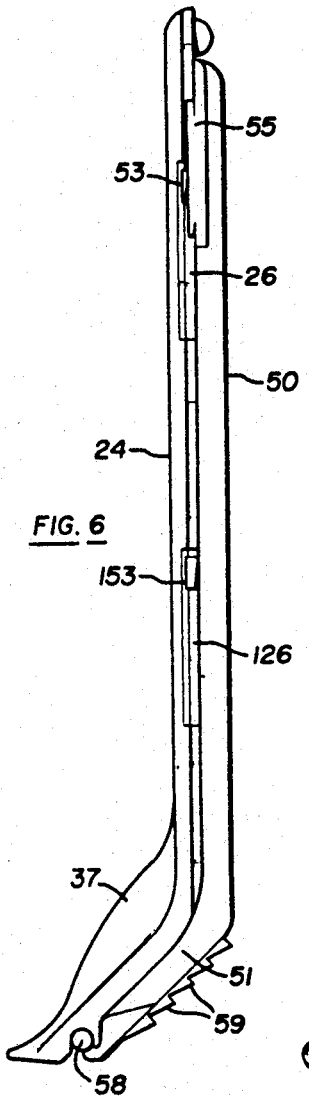
FIG. 6 is a side elevation of the holder device with the two handle members assembled and in their normal position for receiving a disposable wiper sleeve.
Figure 8:
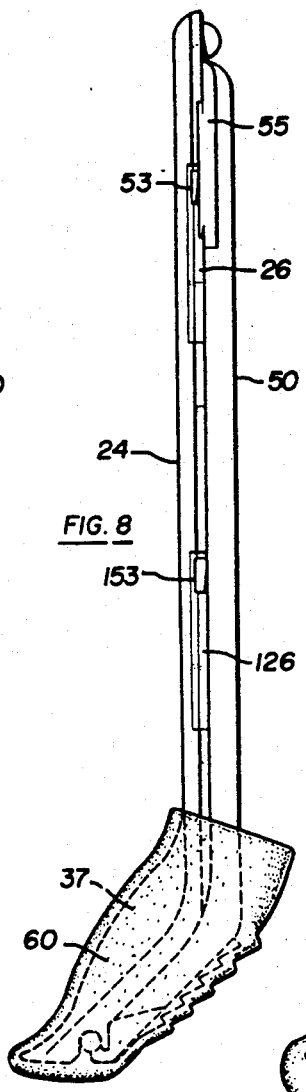
FIG. 8 is a view similar to FIG. 6 but with the disposable wiper sleeve in place on the foot segments of the holder device.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

In broad outline, refering to FIG. 1, the holder device of the present invention comprises an elongated front handle member 20 with a downwardly and forwardly inclined foot segment 21 on its lower end, and an elongated rear handle member 50 slidably coupled to the front handle member 20 and having a downwardly and forwardly inclined foot segment 51 on its lower end directly behind the foot segment 21 of the front handle member.

As shown in FIGS. 2 and 3, the front handle member 20 is generally semi-circular in cross-section but with cut-away outside segments on its opposite sides. As shown in FIG. 1, between points A and B, which may be about 2½ inches apart lengthwise of the front handle, its opposite sides are shaped as shown in FIG. 2, with parallel flat surfaces 22 and 23 extending in from its cylindrical outer face 24 and convex surfaces 25 and 26 extending in from its flat surfaces 22 and 23, respectively. Surfaces 25 and 26 terminate at radially extending, flat, back edges 27 and 28 of the front handle member. Thus, the front handle member presents longitudinal upper recesses in its opposite sides between points A and B, with transverse shoulders 29, 30, 31 and 32, respectively, at the opposite ends of these recesses.

Between points C and D, also about 2½ inches apart, the opposite sides of the front handle 20 are recessed the same way as just described. In FIGS. 1 and 3, surfaces of the front handle between points C and D are given the same reference numerals plus 100 as those between points A and B.

Between the lower end (at B) of the upper recesses and the upper end (at C) of the lower recesses in its opposite sides, the front handle member is formed with longitudinal peripheral grooves 33 which extend forward from the back edges 27 and 28 as far forward as do the convex surfaces 25 and 26 in FIG. 2. Above point A and below point D in FIG. 1 the opposite sides of the front handle member have longitudinal grooves 34 and 35 like those between points B and C.

The foot segment 21 extends from the rest of handle member 20 forward and downward at an angle of about 135 degrees. As shown in FIG. 4 and 5, foot segment 21 is generally V-shaped in cross-section, with opposite sides 36 and 37 extending from a rounded apex 38 on the front to arcuate rear portions 39 and 40, respectively. As shown in FIGS. 1 and 5, the apex 38 of the front of foot segment 21 is convex lengthwise of the foot segment. Foot segment 21 terminates in toe 21(A) which curves upwardly to secure the wiper element 60 on foot segment 21. The rear portions 39 and 40 of foot segment 21 terminate in flat back faces 39*a* and 40*a*, respectively.

Close to its lower end, foot segment 21 is formed with grooves 41 (FIG. 5) in its opposite sides extending up from its back faces 39*a* and 40*a*. Both of these grooves extend parallel to the longitudinal axis of the main part of the front handle 20 and they are offset in front of that axis because of the downward and forward inclination of foot segment 21. Foot segment 21 has rear lips 42 extending down in back of these grooves 41 when the main part of handle member 20 extends upright, as shown in FIG. 1.

The rear handle member 50 (FIG. 1) is semi-cylindrical for most of its length and it extends contiguously behind the front handle member 20. At the upper longitudinal recesses (between points A and B) in the front handle member, the rear handle member presents short, forwardly projecting, concavo-convex lips 52 an 53 (FIG. 2) which extend closely outside the convex surfaces 25 and 26 of the front handle member. Laterally outside these lips the rear handle member has outwardly bowed, forwardly protruding, longer segments 54 and 55 (FIG. 1) which may be easily grasped in a person's hand.

At the lower longitudinal recesses (between points C and D) in the front handle member 20, the rear handle member 50 has short, forwardly projecting, concavo-convex lips 152 and 153 (FIG. 3) which extend closely outside the convex surfaces 125 and 126 of the front handle member.

Normally, as shown in FIG. 1, the lower lip 153 on the rear handle member 50 engages the upper shoulder 129 of the lower longitudinal recess on that side of the front handle member 20. Also, normally, the lower lip 152 on the opposite side of rear handle member 50 engages the upper shoulder 131, of the corresponding lower groove in the front handle member, and the upper lips 52 and 53 on the rear handle member engage the respective upper shoulders 31 and 29 of the upper longitudinal grooves in the front handle member. In this normal position of the parts, the foot segment 51 of the rear handle member extends contiguously behind and below the foot segment 21 of the front handle member.

As shown in FIG. 4, the foot segment 51 of rear handle member 50 is generally semi-circular in cross-section, presenting flat front faces 56 and 57 on its opposite sides slidably engaging the flat rear faces **39*a* and 40*a* of the foot segment 21 of the front handle member 20. At its lower end, the foot segment 51 of the rear handle member has a cross pin 58 which is slidably received in the grooves 41 in foot segment 21 of the front member when the two handle members are in their normal position, as shown in FIG. 1**.

On the back, the foot segment 51 of the rear handle member presents a series of teeth 59, each having a long upwardly and rearwardly inclined bottom face and a shorter upwardly and forwardly inclined upper face when the holder device is in its upright position, as shown in FIGS. 1,6 and 8–10.

Figure 7:
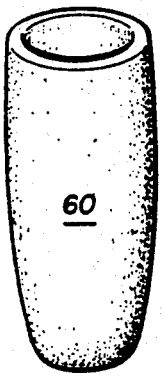
FIG. 7 is a perspective view of a disposable wiper sleeve for use with the holder of FIG. 6.
Figure 11:
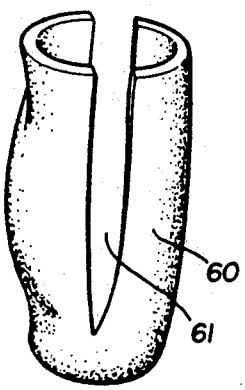
FIG. 11 is a perspective view of the wiper sleeve just after its removal from the present holder device.

FIG. 7 illustrates a disposable wiper element 60 of tubular shape, closed at its lower end, which fits on the contiguous foot segments 21 and 51 of the handle members 20 and 50 when they are in their normal position. Preferably, this wiper element is of soft paper or other suitable absorbent material. With the front and rear handle members 20 and 50 positioned contiguous to one another, as shown in FIG. 6, the wiper element 60 is slid onto the foot segments 21 and 51 to the position shown in FIG. 8. The teeth 59 on the foot segment 51 of the rear handle member prevent the wiper element 60 from slipping off in use.

After use, the wiper element 60 may be removed by sliding the rear handle member 50 down along the front handle member 20. This downward sliding is limited by the engagement of the arcuate lips 52, 53, 152 and 153 on the rear handle member with the respective lower shoulders 32, 30, 132 and 130 of the upper and lower longitudinal recesses in the front handle member 10.

Figure 9:
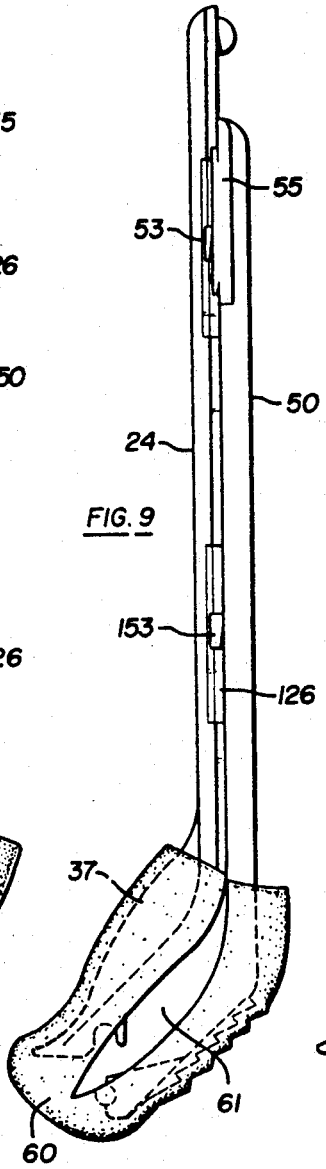
FIG. 9 is a view like FIG. 8 but with the rear handle member shifted part-way down along the front handle member to split the disposable wiper sleeve.
Figure 10:
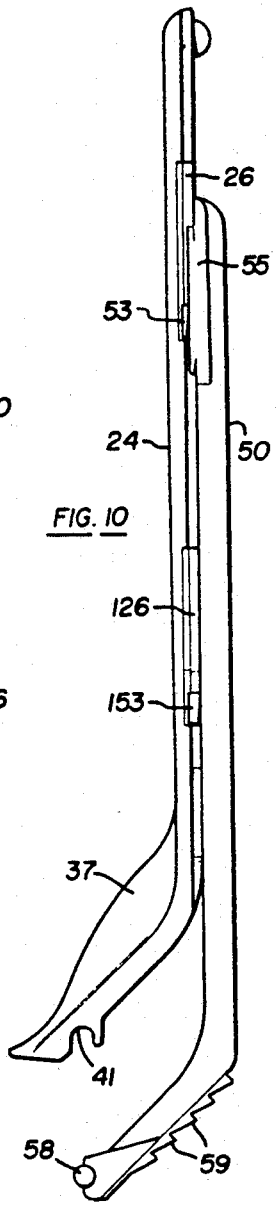
FIG. 10 is a view like FIG. 9 but with the back handle member displaced all the way down to remove to used wiper sleeve.

Initially, as shown in FIG. 9, the downward displacement of the foot segment 51 of rear handle member 50 from the foot segment 21 of front handle member 20 causes the wiper element 60 to split longitudinally, as shown at 61, on both sides. Continued downward displacement of the foot segment 51 of the rear handle member from the foot segment 21 of the front handle member causes the used wiper element 60 to drop off without the necessity of a person's hand touching it.

We claim:

1. In combination, a disposable tubular wiper element, and a personal care device for holding the disposable tubular wiper element, the personal care device comprising; first and second elongated handle members, each having a forwardly and downwardly inclined foot segment at its lower end, said handle members slidably engaging each other for selective manual adjustment between (a) normal position in which said foot segments extend substantially contiguous to each other for reception in said tubular wiper element to hold said wiper element on said foot segments and (b) a position in which said foot segments are spaced apart for splitting said tubular wiper, said inclined foot segments having a toe portion curving forwardly from said foot segment.

2. A device according to claim 1 and further comprising: means providing limit stops for the adjustment of said handle members between said positions.

3. A personal care device for holding a disposable tubular wiper element comprising:

an elongate handle having a forwardly and downwardly inclined foot segment, said foot segment having lateral opposite sides which converge at a rounded apex on a front side of the foot segment and which sides extend laterally from the rounded apex in an inverted V-cross-sectional shape to merge with arcuate portions that extend laterally, arcuately and downwardly from the inverted V-cross-sectional shape.

4. The personal care device as claimed in claim 3 and further comprising:

an elongate handle having front and back slidingly interlocked members, said front member terminating at said foot segment with a front portion that includes said rounded apex and the inverted V-cross-sectional shape, and said back member terminating at said foot segment with an arcuate portion that matingly fits with the front portion of the foot segment.

* * * * *